US010522938B1

(12) United States Patent
Walton et al.

(10) Patent No.: US 10,522,938 B1
(45) Date of Patent: Dec. 31, 2019

(54) ELECTRICAL CONNECTOR WITH NON-UNIFORMLY ARRANGED CONTACTS

(71) Applicant: TE CONNECTIVITY CORPORATION, Berwyn, PA (US)

(72) Inventors: Scott Eric Walton, Mount Joy, PA (US); Graham Harry Smith, Jr., Mechanicsburg, PA (US); Michael Frank Cina, Elizabethtown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/124,275

(22) Filed: Sep. 7, 2018

(51) Int. Cl.

| | |
|---|---|
| ***H01R 13/648*** | (2006.01) |
| ***H01R 13/502*** | (2006.01) |
| ***H01R 13/6471*** | (2011.01) |
| ***H01R 13/6585*** | (2011.01) |
| ***H01R 13/41*** | (2006.01) |

(52) U.S. Cl.
CPC ..... *H01R 13/502* (2013.01); *H01R 13/41* (2013.01); *H01R 13/6471* (2013.01); *H01R 13/6585* (2013.01)

(58) Field of Classification Search
CPC .. H01R 13/502; H01R 13/41; H01R 13/6471; H01R 13/6585
See application file for complete search history.

(56) References Cited

U.S. PATENT DOCUMENTS

| | | | | |
|---|---|---|---|---|
| 5,628,647 | A * | 5/1997 | Rohrbaugh | H01R 13/6463 439/404 |
| 6,793,515 | B1 * | 9/2004 | Gwiazdowski | H01R 13/6463 439/344 |
| 7,011,553 | B2 * | 3/2006 | Hayashi | H01R 13/4367 439/460 |
| 7,604,515 | B2 * | 10/2009 | Siemon | H01R 13/6463 439/676 |
| 7,736,159 | B1 * | 6/2010 | Effinger, III | H01R 24/86 439/108 |
| 8,313,346 | B2 * | 11/2012 | Sparrowhawk | H04B 3/32 439/607.05 |
| 2009/0236121 | A1 * | 9/2009 | Hopkinson | H01B 11/002 174/113 R |
| 2012/0061138 | A1 * | 3/2012 | Pyczak | H01R 9/03 174/72 R |

* cited by examiner

*Primary Examiner* — Xuong M Chung Trans

(57) ABSTRACT

An electrical connector includes a conductive shell, a dielectric holder, and electrical contacts. The conductive shell defines a cavity. The dielectric holder is disposed within the cavity. The electrical contacts are mounted to the dielectric holder within the cavity and are arranged in pairs. The pairs include multiple pairs in a cancellation arrangement and an isolated pair spaced apart from the pairs in the cancellation arrangement. A separation distance from the isolated pair to a closest neighboring electrical contact of the electrical contacts is greater than respective separation distances from each of the pairs in the cancellation arrangement to corresponding closest neighboring electrical contacts of the electrical contacts.

20 Claims, 4 Drawing Sheets

ELECTRICAL CONNECTOR WITH NON-UNIFORMLY ARRANGED CONTACTS

BACKGROUND OF THE INVENTION

The subject matter herein relates generally to electrical connectors for establishing electrically conductive pathways between devices.

Some known electrical connectors have multiple pairs of electrical contacts arranged in pairs to convey differential signals. The transmission of differential signals can be degraded due to electromagnetic interference, or cross-talk, that couples to a corresponding contact pair from one or more adjacent pairs of the electrical contacts.

One way to reduce the deleterious effects of cross-talk is to increase the spacing between contact pairs, but this strategy may not be available for connectors with a predefined component sizes and designated contact densities. For example, although packing fewer electrical contacts in an electrical connector may allow for improved signal transmission (e.g., reduced cross-talk) due to increased isolation between the contacts, it may not be desirable or permissible to reduce the contact density, as there is a general trend towards increasing contact density in connectors.

Some known connectors attempt to shield the electrical contacts against cross-talk by installing electrically conductive shield members or layers between adjacent contact pairs. The shielding may increase the complexity and cost of the connectors by adding additional parts and assembly steps.

A need remains for an electrical connector with multiple pairs of electrical contacts that meets signal transmission performance requirements without complex and costly shielding between the pairs.

BRIEF DESCRIPTION OF THE INVENTION

In one or more embodiments, an electrical connector is provided that includes a conductive shell, a dielectric holder, and electrical contacts. The conductive shell defines a cavity. The dielectric holder is disposed within the cavity. The electrical contacts are mounted to the dielectric holder within the cavity and are arranged in pairs. The pairs include multiple pairs in a cancellation arrangement and an isolated pair spaced apart from the pairs in the cancellation arrangement. A separation distance from the isolated pair to a closest neighboring electrical contact of the electrical contacts is greater than respective separation distances from each of the pairs in the cancellation arrangement to corresponding closest neighboring electrical contacts of the electrical contacts.

In one or more embodiments, an electrical connector is provided that includes a shell, a dielectric holder, and electrical contacts. The shell defines a cavity. The dielectric holder is disposed within the cavity. The electrical contacts are mounted to the dielectric holder within the cavity and are arranged in pairs. The pairs include a center pair, a first side pair, and a second side pair in a cancellation arrangement and an isolated pair spaced apart from the cancellation arrangement. The center pair is disposed between the first side pair and the second side pair. The electrical contacts of the center pair are oriented along a center axis, the electrical contacts of the first side pair are oriented along a first side axis that is oblique to the center axis, and the electrical contacts of the second side pair are oriented along a second side axis that is oblique to the center axis and transverse to the first side axis.

In one or more embodiments, an electrical connector is provided that includes a conductive shell, a dielectric holder, and electrical contacts. The conductive shell defines a cavity that has a circular cross-sectional shape. The dielectric holder is disposed within the cavity. The dielectric holder has a front face, a rear face opposite the front face, and an outer surface extending from the front face to the rear face. The electrical contacts are mounted to the dielectric holder within the cavity and are arranged in pairs. The pairs include multiple pairs in a cancellation arrangement and an isolated pair spaced apart from the pairs in the cancellation arrangement. A separation distance from the isolated pair to a closest neighboring electrical contact of the electrical contacts is greater than respective separation distances from each of the pairs in the cancellation arrangement to corresponding closest neighboring electrical contacts of the electrical contacts.

DETAILED DESCRIPTION OF THE INVENTION

Embodiments of the present disclosure provide an electrical connector that has multiple pairs of electrical contacts in a specific configuration designed to reduce the detrimental effects of electromagnetic interference (e.g., cross-talk). In the configuration, the pairs of electrical contacts are non-uniformly distributed along a mating area of the connector. For example, the spacing between some adjacent pairs of contacts may be greater than the spacing between other adjacent pairs. In addition, the pairs of contacts are oriented along respective pair axes that are defined through both contacts in the respective pair. In the configuration disclosed herein, not all of the pair axes are parallel or perpendicular to each other, but rather at least one pair axis is oblique to another pair axis.

In one or more embodiments, some of the pairs of electrical contacts are arranged relatively close together with specific positions and orientations relative to each other in order to utilize cancellation to improve cross-talk resistance. At least one pair of the electrical contacts is spaced relatively far apart from neighboring contact pairs (e.g., farther than the respective spacing between the pairs that utilize cancellation) in order to improve cross-talk resistance by distance-based isolation.

In one or more embodiments, the electrical connector does not have electrically conductive shields that surround individual contact pairs to electrically shield the contact pairs from cross-talk and other electromagnetic interference. The electrical conductor also lacks electrically conductive shield members with partition walls that extend between and separate each of the contact pairs. The electrical connector may have an electrically conductive shell that collectively surrounds the contact pairs. In one or more embodiments, at least some adjacent contact pairs may not be shielded from each other, such that the cross-talk resistance for these contact pairs is provided by cancellation and/or isolation, but not intervening shielding.

At least one technical effect of the embodiments of the electrical connector disclosed herein may be reduced cost and complexity relative to known electrical connectors due to installing fewer, if any, electrically conductive shield members and/or layers between adjacent contact pairs. Another technical effect of the embodiments disclosed herein may be the ability to meet or exceed certain signal transmission quality standards or requirements with greater contact density than known electrical connectors attributable to the disclosed configuration of the electrical contacts. Conversely, for a given connector size and contact size, and a desired contact density, the electrical connector according to the embodiments disclosed herein may provide improved signal transmission quality than known electrical connectors attributable to the disclosed configuration of the electrical contacts.

Figure 1:
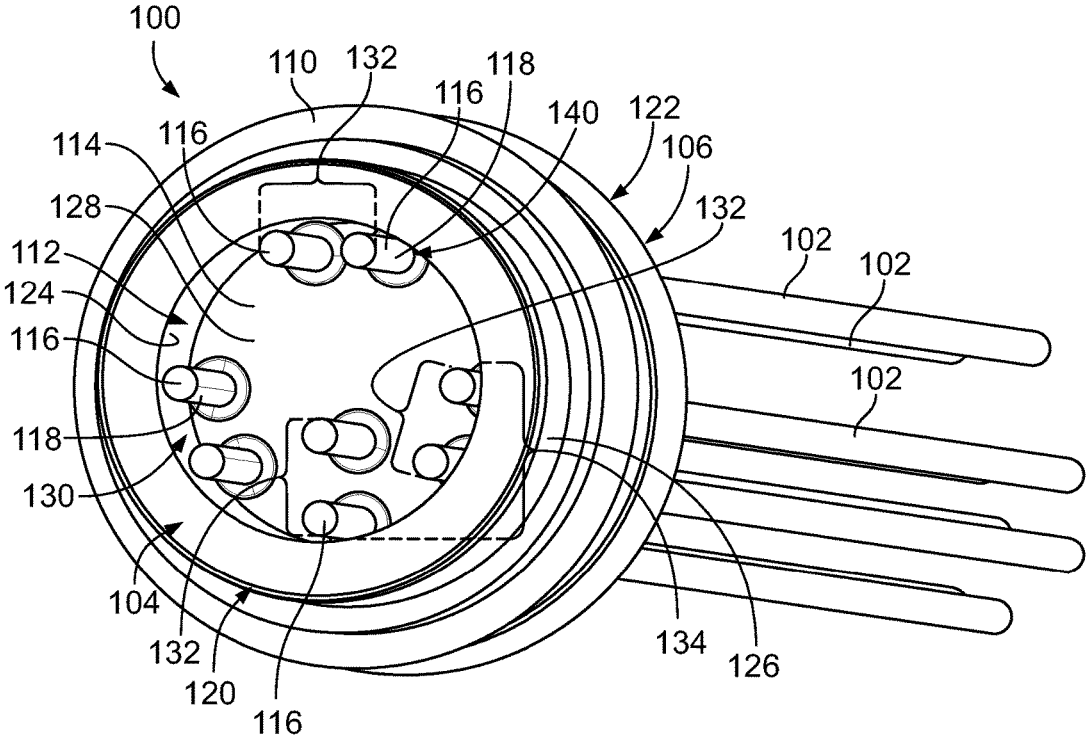
FIG. 1 is a perspective view of an electrical connector according to an embodiment.

FIG. 1 is a perspective view of an electrical connector 100 according to an embodiment. The electrical connector 100 is mounted to multiple electrical cable 102. Each cable 102 optionally may be an insulated wire. Although only segments of the cables 102 are shown in FIG. 1, the cables 102 may extend from the connector 100 to an electrical device, such as a circuit board or the like. The electrical connector 100 has a front end 104 and a rear end 106 opposite the front end 104. In the illustrated embodiment, the front end 104 represents a mating end that is configured to engage and couple to a complementary mating connector to provide a conductive pathway across the connectors. The cables 102 project from the rear end 106 of the electrical connector 100. As used herein, relative or spatial terms such as "front," "rear," "upper," "lower," "interior," and "exterior," are only used to identify and distinguish the referenced elements in the illustrated orientations and do not necessarily require particular positions or orientations relative to gravity and/or the surrounding environment of the electrical connector 100.

The electrical connector 100 includes a shell or housing 110 that defines a cavity 112. The electrical connector 100 also includes a dielectric holder 114 and plural electrical contacts 116. The dielectric holder 114 is disposed within the cavity 112, and holds the electrical contacts 116 in place at designated positions. For example, the dielectric holder 114 may hold the electrical contacts 116 (also referred to herein as contacts 116) at specific positions to utilize cancellation and isolation to resist cross-talk. The contacts 116 are electrically terminated to the cables 102, such that the contacts 116 are electrically connected and mechanically secured to the cables 102. For example, the contacts 116 optionally may be crimped or soldered to conductive cores of the cables 102. In the illustrated embodiment, each of the contacts 116 is terminated to a different corresponding one of the cables 102. For example, the connector 100 has eight contacts 116 in FIG. 1, and eight cables 102 project from the rear end 106 of the connector 100.

The contacts 116 are configured to engage complementary contacts of a mating connector at a mating interface that is at or proximate to the front end 104. In the illustrated embodiment, the contacts 116 include pins 118 that are configured to be received into sockets of mating contacts. In an alternative embodiment, the contacts 116 may have a different shape, such as a blade, a tube that defines a socket, a deflectable spring beam, or the like.

The shell 110 has a front end 120 and a rear end 122 opposite the front end 120. The front and rear ends 120, 122 of the shell 110 optionally define the front and rear ends 104, 106, respectively, of the connector 100. The shell 110 according to one or more embodiments is electrically conductive. Due to the conductive property of the shell 110, the shell 110 may provide shielding against electromagnetic interference between the electrical connector 100 and adjacent connectors and other electronic devices. The shell 110 includes an electrically conductive material. For example, the electrically conductive material may be one or more metals, intrinsically conducting polymer (ICP) materials, lossy dielectric materials, or the like. A lossy dielectric material has a dielectric substrate impregnated with metal particles.

The shell 110 has an inner surface 124 and an outer surface 126. The inner surface 124 defines the cavity 112. The cavity 112 may extend fully through the shell 110 from the front end 120 to the rear end 122. In the illustrated embodiment, the cavity 112 has a circular cross-sectional shape. In an alternative embodiment, the cavity 112 may have another rounded shape, such as oval, elliptical, or a polygon with rounded corners. The outer surface 126 in FIG. 1 is generally cylindrical, but may have another shape in an alternative embodiment. The outer surface 126 represents an outer surface of the connector 100 such that the outer surface 126 is exposed to the ambient environment (e.g., is not surrounded by another component). In an alternative embodiment, the electrical connector 100 may have an additional housing component that surrounds the outer surface 126 of the shell 110.

The dielectric holder 114 may include a dielectric material, such as one or more plastics. The dielectric material optionally may be Polytetrafluoroethylene (PTFE) or another polymer having a relatively low dielectric constant to provide electrical insulation. The dielectric holder 114 may be recessed from the front end 120 of the shell 110. The dielectric holder 114 has a front face 128 that is spaced apart from the front end 120 to define a receiving space 130 within the shell 110 that receives a portion of the mating connector. The pins 118 project beyond the front face 128 of the dielectric holder 114 and are exposed within the receiving space 130 to engage complementary contacts of the mating connector.

The electrical contacts 116 are arranged in pairs 132. Each pair 132 may be configured to transmit differential signals, such that the pairs 132 may be differential pairs. A pair 132 may transmit a differential signal based on a voltage difference between the two conductive paths defined along the two contacts 116 of the pair 132, so the two contacts 116 in the pair 132 may be located relatively close together. In one or more embodiments, some of the pairs 132 of contacts 116 are grouped in a cancellation arrangement 134 and at least one other pair 132 is spaced apart from the pairs 132 in the cancellation arrangement 134. FIG. 1 shows one isolated pair 140 that is spaced apart from the cancellation arrangement 134.

Figure 2:
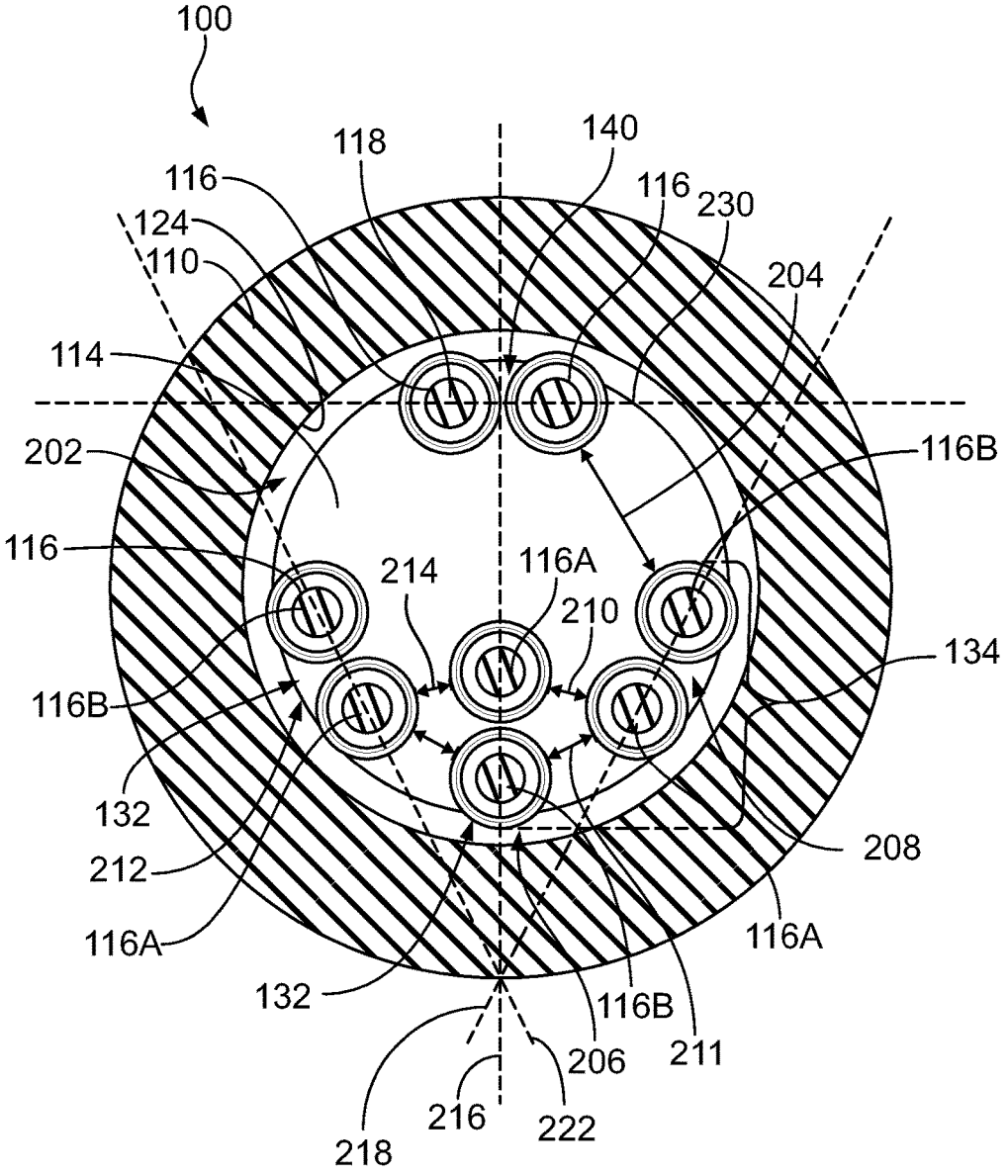
FIG. 2 is a front cross-sectional view of the electrical connector shown in FIG. 1.

FIG. 2 is a front cross-sectional view of the electrical connector 100 shown in FIG. 1. The cross-section line is taken through the shell 110 and the pins 118 of the electrical contacts 116 within the receiving space 130 (shown in FIG. 1). In the illustrated embodiment, the connector 100 has one isolated pair 140 of contacts 116 and multiple pairs 132 in the cancellation arrangement 134. At least some of the electrical contacts 116 are located proximate to the inner surface 124 of the shell 110 but are spaced apart from the inner surface 124 such that none of the contacts 116 engages the shell 110. For example, the contacts 116 may be separated from the inner surface 124 via an air gap 202 or an intervening dielectric collar or sleeve to avoid electrical shorting of the contacts 116.

The isolated pair 140 is more isolated from neighboring pairs 132 of contacts 116 than the pairs 132 in the cancellation arrangement 134. For example, the isolated pair 140 is spaced apart from a closest neighboring electrical contact 116 by a first separation distance 204. The separation distances described herein refer to the distances between the closest two contacts 116 of different, neighboring pairs 132. The first separation distance 204 is between one contact 116 of the isolated pair 140 and the closest neighboring contact 116 (of a different pair 132) to that contact 116 of the isolated pair 140. The pairs 132 in the cancellation arrangement 134 are disposed closer to one another than to the isolated pair 140. For example, a first pair 206 in the cancellation arrangement 134 is spaced apart from a second pair 208 in the cancellation arrangement 134 by a second separation distance 210. The second separation distance 210 is less than the first separation distance 204. In another example, a third pair 212 in the cancellation arrangement 134 is spaced apart from the first pair 206 via a third separation distance 214. The third separation distance 214 is also less than the first separation distance 204. The second and third separation distances 210, 214 may be approximately equivalent (e.g., within 1%, 5%, or 10% of each other), or at least similar in length to one another (e.g., within 25% of each other).

The relatively large spacing between the isolated pair 140 and the pairs 132 in the cancellation arrangement 134 allows for reduced electromagnetic interference (e.g., cross-talk) between the isolated pair 140 and the pairs 132 in the cancellation arrangement 134 relative to configurations with narrower spacing. The reduction in electromagnetic interference may be due to the electromagnetic energy having to travel a relatively large distance through a dielectric medium, such as the dielectric holder 114 and/or air, between the isolated pair 140 and the neighboring pairs 132 in the cancellation arrangement 134, such that a reduced amount of energy travels the full separation distance 210. The isolated pair 140 is configured to resist cross-talk via distance from other contacts 116 of the connector 100.

In the illustrated embodiment, the pairs 132 in the cancellation arrangement 134 include the first pair 206, the second pair 208, and the third pair 212. The three pairs 206, 208, 212 represent all of the pairs 132 in the cancellation arrangement 134. In FIG. 2, the electrical connector 100 has four total pairs 132 of contacts 116 (e.g., eight total contacts 116), defined by the single isolated pair 140 and the three pairs 206, 208, 212. The electrical connector 100 may have more or less contacts 116 in an alternative embodiment. For example, the cancellation arrangement 134 may have only the first and second pairs 206, 208 in one alternative embodiment.

In the cancellation arrangement 134, the first pair 206 is adjacent to the second pair 208. The contacts 116 in the first pair 206 are oriented in a first axis 216. For example, the first axis 216 extends through the center of each of the pins 118 of the two contacts 116 in the first pair 206. The contacts 116 in the second pair 208 are oriented in a second axis 218. In the illustrated embodiment, the second axis 218 is oblique to the first axis 216, such that the second axis 218 is transverse to the first axis 216 but is not perpendicular to the first axis 216. Thus, the second axis 218 is neither parallel nor perpendicular to the first axis 216.

The first pair 206 is also adjacent to the third pair 212. For example, the first pair 206 may be disposed between the second and third pairs 208, 212. The first pair 206 is also referred to herein as a center pair 206, and the first axis 216 is referred to as a center axis 216. The second and third pairs 208, 212 are also referred to herein as a first side pair 208 and a second side pair 212, respectively. The second axis 218 is referred to as a first side axis 218. The contacts 116 of the second side pair 212 are oriented in a second side axis 222. The second side axis 222 is oblique (e.g., neither parallel nor perpendicular) to the center axis 216. The first and second side axes 218, 222 are transverse to each other, such that the axes 218, 222 are not parallel. Although the first and second axes 218, 222 form an acute angle in FIG. 2, the axes 218, 222 may be perpendicular or obtuse in an alternative embodiment.

The contacts 116 in the isolated pair 140 are oriented along an isolation axis 230. The isolation axis 230 in the illustrated embodiment is perpendicular (e.g., orthogonal) to the center axis 216. Thus, the center pair 206 is perpendicular to the isolated pair 140. The center pair 206 and the isolated pair 140 may be relatively positioned such that the center axis 216 bisects the isolated pair 140. For example, as shown in FIG. 2, the center axis 216 extends between the two contacts 116 of the isolated pair 140. In this positioning, the contacts 116 of the isolated pair 140 are equidistant from the contacts 116 of the center pair 206. In addition to the relatively large spacing as described above, the equidistance between the isolated pair 140 and the center pair 206 resists cross-talk because an electromagnetic noise voltage from the center pair 206 to the isolated pair 140, for example, would affect both contacts 116 of the isolated pair 140. Because differential signals are treated as the difference between the voltages on the two conducting paths, a common noise voltage coupled to both contacts 116 does not affect the signal. For example, the electromagnetic noise applied to the two contacts 116 would effectively cancel.

In the illustrated embodiment, one electrical contact 116A of the first side pair 208 is approximately located equidistant between the two contacts 116 of the center pair 206. For example, the separation distance 210 between the contact 116A of the first side pair 208 and a first contact 116A of the center pair 206 may be approximately equal (e.g., within 1%, 5%, or 10%) of the separation distance 211 between the contact 116A of the first side pair 208 and a second contact 116B of the center pair 206. In this equidistant position, at least some of the noise between the contact 116A of the first side pair 208 and the two contacts 116A, 116B of the center pair 206 effectively cancels, as described above, because the noise is common to both contacts 116A, 116B in the center pair 206. In the illustrated embodiment, the other electrical contact 116B of the first side pair 208 is not approximately equidistant from the two contacts 116 of the center pair 206. For example, the second contact 116B is located closer to the first contact 116A of the center pair 206 than the second contact 116B. The second contact 116B of the first side pair 208 is spaced farther apart from the center pair 206 than the first contact 116A. The distance between the second contact 116B and the center pair 206 provides isolation to resist cross-talk.

The second side pair 212 may mirror the first side pair 208 on opposite sides of the center pair 206. For example, the electrical contacts 116 in the illustrated configuration may be symmetric about the center axis 216. One electrical contact 116A of the second side pair 212 is approximately located equidistant between the two contacts 116 of the center pair 206. The other electrical contact 116B of the second side pair 212 is not equidistant from the two contacts 116 of the center pair 206, but is spaced farther apart from the center pair 206 than the first contact 116A of the second side pair 212, and the isolation resists cross-talk.

Figure 3:
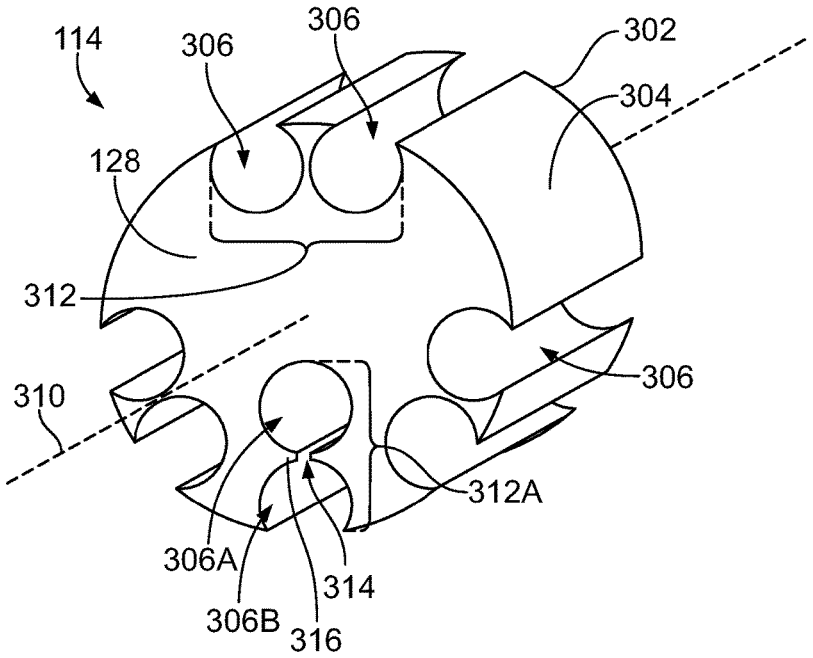
FIG. 3 is an isolated perspective view of a dielectric holder of the electrical connector shown in FIGS. 1 and 2.

FIG. 3 is an isolated perspective view of the dielectric holder 114 of the electrical connector 100 shown in FIGS. 1 and 2. The dielectric holder 114 has the front face 128, a rear face 302 opposite the front face 128, and an outer surface 304 extending along a longitudinal axis 310 from the front face 128 to the rear face 302. In FIG. 3, the dielectric holder 114 has a cylindrical shape, but may have a different shape in other embodiments, such as a polygonal prism shape.

The dielectric holder 114 defines multiple channels 306 along the outer surface 304. The channels 306 are circumferentially spaced apart along a perimeter of the dielectric holder 114. The channels 306 are elongated parallel to the longitudinal axis 310. Each channel 306 may extend the full length of the dielectric holder 114 such that the channels 306 are open along the front and rear faces 128, 302. The channels 306 have cylindrical shapes in the illustrated embodiment, but may have one or more planar surfaces in an alternative embodiment.

The channels 306 are configured to receive the electrical contacts 116 (shown in FIG. 2) therein. Each contact 116 may be loaded into a different corresponding channel 306. The channels 306 are sized to hold the contacts 116 securely in a fixed position. For example, the dielectric holder 114 may be at least partially pliable such that the contacts 116 can be snapped into the channels 306 by pressing the contacts 116 radially inward from the perimeter of the holder 114. In the illustrated embodiment, the channels 306 are arranged in a specific configuration to allow for the contacts 116 within the dielectric holder 114 to achieve the arrangement shown in FIG. 2. The channels 306 are arranged in pairs 312, and each pair 312 holds a different corresponding pair 132 (shown in FIG. 2) of the contacts 116. Optionally, portions of the cables 102 (shown in FIG. 1) may extend into the channels 306.

In FIG. 3, both of the channels 306 of most pairs 312 are located adjacent to each other along the perimeter of the dielectric holder 114, such that the two channels 306 are circumferentially spaced apart. For example, the electrical contacts 116 of the isolated pair 140 (shown in FIG. 2) and at least some of the electrical contacts 116 in the cancellation arrangement 134 (FIG. 2) are held within these channels 306 that are discretely formed along the outer surface 304 of the dielectric holder 114. In one pair 312A, the channels 306 are radially spaced apart from each other, but not circumferentially spaced apart. The pair 312A of channels 306 is configured to receive the center pair 206 (FIG. 2) of contacts 116. In an embodiment, the first contact 116A (FIG. 2) of the center pair 206 may be loaded into an inner channel 306A of the pair 312A by moving from the perimeter through an outer channel 306B of the pair 312A across a partition wall 316 that divides the two channels 306A, 306B to enter the inner channel 306A. The partition wall 316 may define a slot 314 that is expandable due to the force of the contact 116A to allow the contact 116A to cross into the inner channel 306A.

Figure 4:
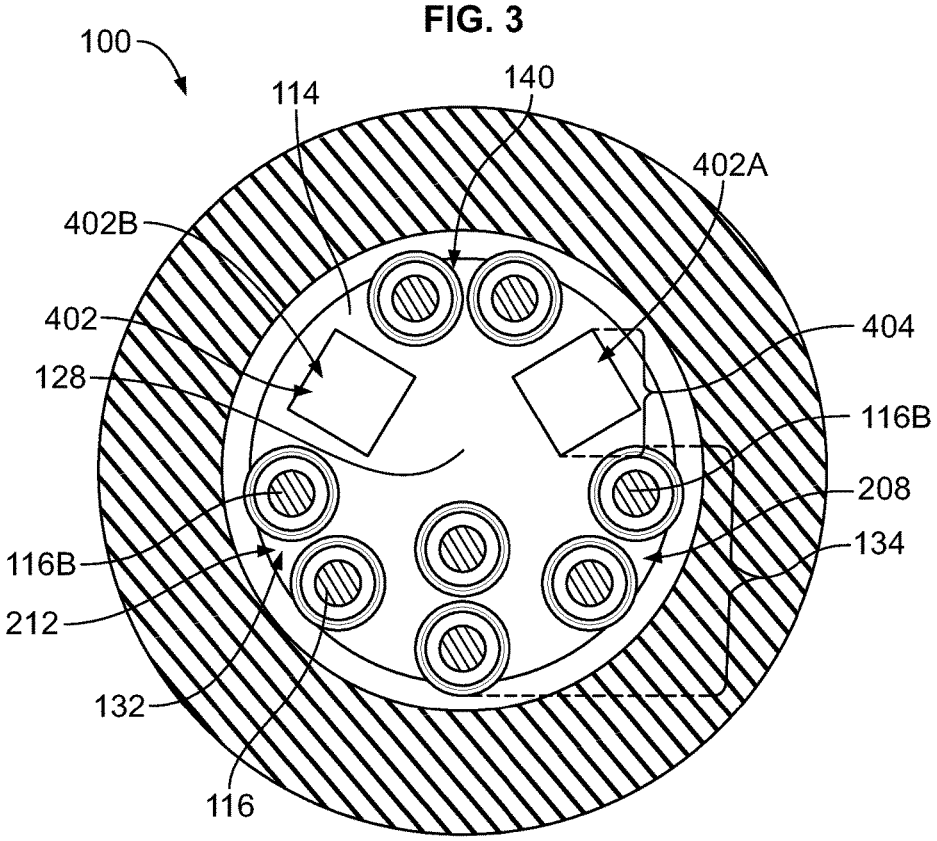
FIG. 4 is a front cross-sectional view of the electrical connector according to an alternative embodiment.

FIG. 4 is a front cross-sectional view of the electrical connector 100 according to an alternative embodiment. Unlike the electrical connector 100 shown in FIGS. 1-3, the dielectric holder 114 in FIG. 4 defines one or more air pockets 402 therein. The air pockets 402 are hollow openings in the dielectric holder 114 that allow ambient air to flow into the air pockets 402. The air within the pockets 402 has a low dielectric constant, and may improve the resistance to cross-talk and other electromagnetic interference between the pairs 132 of contacts 116.

In the illustrated embodiment, the dielectric holder 114 includes two air pockets 402 that are spaced apart from each other. In FIG. 4, the air pockets 402 are open along the front face 128 of the dielectric holder 114. The air pockets 402 optionally may extend fully through the dielectric holder 114 to the rear face 302 (shown in FIG. 3). Both air pockets 402 are located in a vacant region 404 of the dielectric holder 114 between the isolated pair 140 and the pairs 132 in the cancellation arrangement 134. A first air pocket 402A of the two pockets 402 is disposed between the isolated pair 140 and the second contact 116B of the first side pair 208. A second air pocket 402B of the two pockets 402 is disposed between the isolated pair 140 and the second contact 116B of the second side pair 212. The low loss property of the air within the air pockets 402A, 402B may reduce cross-talk between the isolation pair 140 and the first and second side pairs 208, 212.

In an alternative embodiment, the dielectric holder 114 may define only one or more than two air pockets 402. For example, the two air pockets 402A, 402B shown in FIG. 4 may be combined into a single air pocket 402 by removing the material of the dielectric holder 114 that separates the two air pockets 402A, 402B.

Figure 5:
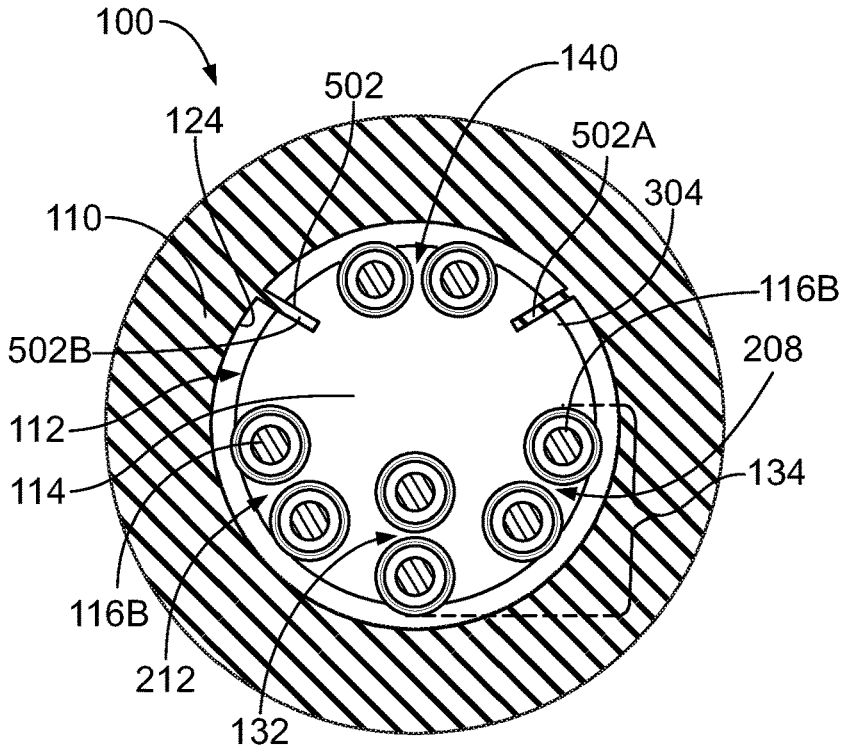
FIG. 5 is a front cross-sectional view of the electrical connector according to a second alternative embodiment.

FIG. 5 is a front cross-sectional view of the electrical connector 100 according to a second alternative embodiment. Unlike the electrical connector 100 shown in FIGS. 1-4, the shell 110 in FIG. 5 includes two ribs 502 that project from the inner surface 124 of the shell 110 include the cavity 112. The two ribs 502 may be electrically conductive. The ribs 502 may be integral to the shell 110 or discrete and coupled to the inner surface 124. The ribs 502 penetrate the outer surface 304 of the dielectric holder 114 at respective locations between the isolated pair 140 and the pairs 132 in the cancellation arrangement 134 to provide electrical shielding between the isolated pair 140 and the pairs 132 in the cancellation arrangement 134. For example, a first rib 502A of the ribs 502 extends between the isolated pair 140 and the second contact 116B of the first side pair 208. A second rib 502B of the ribs 502 is disposed on the other side of the isolated pair 140. The second rib 502B is between the isolated pair 140 and the second contact 116B of the second side pair 212. The electrical conductivity of the ribs 502 may reduce cross-talk between the isolation pair 140 and the first and second side pairs 208, 212 by shielding.

Figure 6:
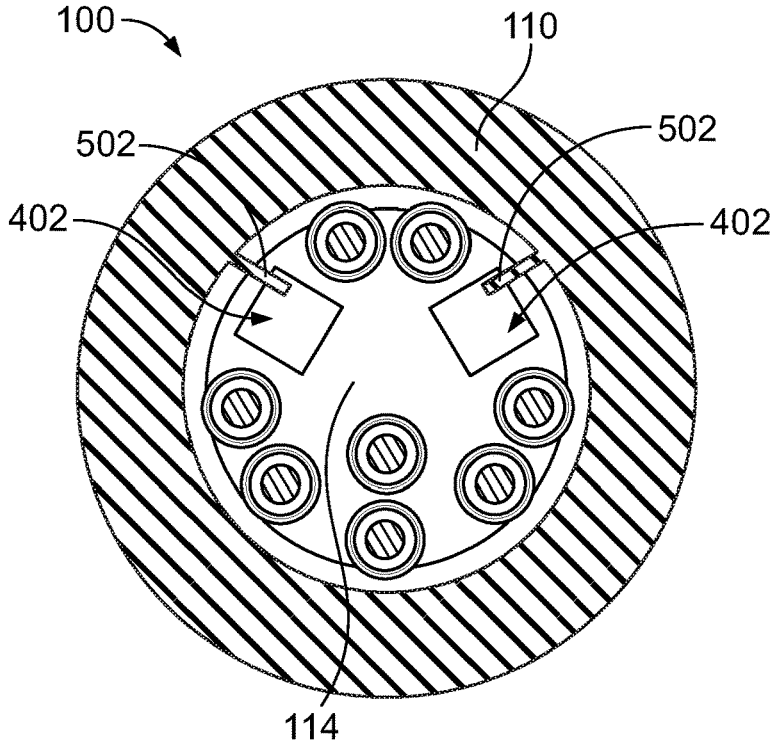
FIG. 6 is a front cross-sectional view of the electrical connector according to a third alternative embodiment.

FIG. 6 is a front cross-sectional view of the electrical connector 100 according to a third alternative embodiment. The illustrated embodiment in FIG. 6 combines aspects of the alternative embodiments shown in FIGS. 4 and 5. For example, the electrical connector 100 in FIG. 6 includes the air pockets 402 in the dielectric holder 114 and the ribs 502 that extend from the shell 110 to provide shielding.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a conductive shell defining a cavity;

a dielectric holder disposed within the cavity; and electrical contacts mounted to the dielectric holder within the cavity and arranged in pairs, the pairs including multiple pairs in a cancellation arrangement and an isolated pair spaced apart from the pairs in the cancellation arrangement, wherein a separation distance from the isolated pair to a closest neighboring electrical contact of the electrical contacts is greater than respective separation distances from each of the pairs in the cancellation arrangement to corresponding closest neighboring electrical contacts of the electrical contacts.

2. The electrical connector of claim 1, wherein the cavity has a circular cross-sectional shape.

3. The electrical connector of claim 1, wherein the pairs in the cancellation arrangement include a first pair and a second pair adjacent to the first pair, wherein the electrical contacts of the first pair are oriented along a first axis and the electrical contacts of the second pair are oriented along a second axis that is oblique to the first axis.

4. The electrical connector of claim 1, wherein the pairs in the cancellation arrangement include a center pair adjacent to and disposed between a first side pair and a second side pair, and wherein the electrical contacts of the center pair are oriented along a center axis, the electrical contacts of the first side pair are oriented along a first side axis that is oblique to the center axis, and the electrical contacts of the second side pair are oriented along a second side axis that is oblique to the center axis and transverse to the first side axis.

5. The electrical connector of claim 4, wherein the electrical contacts of the isolated pair are oriented along an isolation axis that is perpendicular to the center axis and are positioned relative to the center pair such that the center axis bisects the isolated pair.

6. The electrical connector of claim 4, wherein one electrical contact in each of the first side pair and the second side pair is approximately equidistant from the two electrical contacts of the center pair, and the other electrical contact in each of the first and second side pairs is not approximately equidistant from the two electrical contacts of the center pair.

7. The electrical connector of claim 1, wherein the dielectric holder has a front face, a rear face opposite the front face, and an outer surface extending from the front face to the rear face, the dielectric holder defining channels along the outer surface that are circumferentially spaced apart along a perimeter of the dielectric holder, wherein the electrical contacts of the isolated pair and at least some of the electrical contacts in the cancellation arrangement are held within the channels.

8. The electrical connector of claim 1, wherein the electrical connector has four total pairs of the electrical contacts including three pairs in the cancellation arrangement and the isolated pair.

9. The electrical connector of claim 1, wherein the dielectric holder defines one or more air pockets therein, the one or more air pockets disposed between the isolated pair and the pairs in the cancellation arrangement.

10. The electrical connector of claim 1, wherein the conductive shell includes ribs that project into the cavity, the ribs penetrating an outer surface of the dielectric holder at respective locations between the isolated pair and the pairs in the cancellation arrangement to provide electrical shielding between the isolated pair and the pairs in the cancellation arrangement.

11. An electrical connector comprising:

a shell defining a cavity;

a dielectric holder disposed within the cavity; and electrical contacts mounted to the dielectric holder within the cavity and arranged in pairs, the pairs including a center pair, a first side pair, and a second side pair in a cancellation arrangement and an isolated pair spaced apart from the cancellation arrangement, the center pair disposed between the first side pair and the second side pair;

wherein the electrical contacts of the center pair are oriented along a center axis, the electrical contacts of the first side pair are oriented along a first side axis that is oblique to the center axis, and the electrical contacts of the second side pair are oriented along a second side axis that is oblique to the center axis and transverse to the first side axis.

12. The electrical connector of claim 11, wherein the shell is electrically conductive.

13. The electrical connector of claim 11, wherein a separation distance from the isolated pair to a closest neighboring electrical contact of the electrical contacts is greater than respective separation distances from each of the center pair, the first side pair, and the second side pair to corresponding closest neighboring electrical contacts of the electrical contacts.

14. The electrical connector of claim 11, wherein the cavity has a circular cross-sectional shape.

15. The electrical connector of claim 11, wherein one electrical contact in each of the first side pair and the second side pair is approximately equidistant from the two electrical contacts of the center pair, and the other electrical contact in each of the first and second side pairs is not approximately equidistant from the two electrical contacts of the center pair.

16. The electrical connector of claim 11, wherein the electrical contacts of the isolated pair are oriented along an isolation axis that is perpendicular to the center axis and are positioned relative to the center pair such that the center axis bisects the isolated pair.

17. The electrical connector of claim 11, wherein the dielectric holder has a front face, a rear face opposite the front face, and an outer surface extending from the front face to the rear face, the dielectric holder defining channels along the outer surface that are circumferentially spaced apart along a perimeter of the dielectric holder, wherein the electrical contacts of the isolated pair and at least some of the electrical contacts in the cancellation arrangement are held within the channels.

18. The electrical connector of claim 11, wherein the dielectric holder defines a first air pocket and a second air pocket that are spaced apart from each other, the first air pocket disposed between the isolated pair and the first side pair, the second air pocket disposed between the isolated pair and the second side pair.

19. An electrical connector comprising:

a conductive shell defining a cavity that has a circular cross-sectional shape;

a dielectric holder disposed within the cavity, the dielectric holder having a front face, a rear face opposite the front face, and an outer surface extending from the front face to the rear face; and electrical contacts mounted to the dielectric holder within the cavity and arranged in pairs, the pairs including multiple pairs in a cancellation arrangement and an isolated pair spaced apart from the pairs in the cancellation arrangement, wherein a separation distance from the isolated pair to a closest neighboring electrical contact of the electrical contacts is greater than respective separation distances from each of the pairs in the cancellation arrangement to corresponding closest neighboring electrical contacts of the electrical contacts.

20. The electrical connector of claim 19, wherein the dielectric holder defines channels along the outer surface that are circumferentially spaced apart along a perimeter of the dielectric holder, and at least some of the electrical contacts are held within the channels.

* * * * *